US010429087B2

(12) United States Patent
Shishido et al.

(10) Patent No.: US 10,429,087 B2
(45) Date of Patent: Oct. 1, 2019

(54) INDOOR UNIT FOR AIR-CONDITIONING APPARATUS

(71) Applicant: Mitsubishi Electric Corporation, Tokyo (JP)

(72) Inventors: Takahiro Shishido, Tokyo (JP); Yusuke Adachi, Tokyo (JP); Mitsuhiro Shirota, Tokyo (JP); Takashi Ikeda, Tokyo (JP); Yoshinori Tanikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/780,257

(22) PCT Filed: Feb. 1, 2016

(86) PCT No.: PCT/JP2016/052879
§ 371 (c)(1),
(2) Date: May 31, 2018

(87) PCT Pub. No.: WO2017/134723
PCT Pub. Date: Aug. 10, 2017

(65) Prior Publication Data

US 2019/0056119 A1 Feb. 21, 2019

(51) Int. Cl.
*F24H 3/06* (2006.01)
*F28F 13/12* (2006.01)
(Continued)

(52) U.S. Cl.
CPC ..... *F24F 1/0011* (2013.01); *F24F 1/0025* (2013.01); *F24F 1/0057* (2019.02); *F24F 13/10* (2013.01); *F24F 13/20* (2013.01)

(58) Field of Classification Search
CPC ..... F24F 1/0007; F24F 1/0011; F24F 1/0057; F24F 1/0025; F24F 13/10; F24F 13/20; B60H 1/00292
(Continued)

(56) References Cited

U.S. PATENT DOCUMENTS 3,812,772 A * 5/1974 Kaiser ..... A01K 1/0064 454/319
4,562,957 A * 1/1986 Nakagawa ..... B60H 1/00292 219/202
(Continued)

FOREIGN PATENT DOCUMENTS

CN 1506626 A 6/2004
EP 0811810 A2 12/1997
(Continued)

OTHER PUBLICATIONS

Office Action dated Apr. 16, 2019 issued in corresponding CN patent application No. 201680004003.X (and English translation).
(Continued)

*Primary Examiner* — Davis D Hwu
(74) *Attorney, Agent, or Firm* — Posz Law Group, PLC

(57) ABSTRACT

An indoor unit for an air-conditioning apparatus includes a box-shaped casing having an air inlet in a top surface of the casing and an air outlet in a bottom surface of the casing, an air-sending device disposed in the casing and configured to suck in indoor air through the air inlet and blow conditioned air through the air outlet, a heat exchanger disposed in the casing and configured to cause the indoor air to exchange heat with refrigerant to supply the conditioned air, a vertical deflector, a first auxiliary vertical deflector, and a second auxiliary vertical deflector each rotatably arranged in the air outlet and configured to change an air flow direction in a vertical direction.

6 Claims, 6 Drawing Sheets

(51) Int. Cl.

| | |
|---|---|
| ***F24F 1/0011*** | (2019.01) |
| ***F24F 13/10*** | (2006.01) |
| ***F24F 1/0057*** | (2019.01) |
| ***F24F 1/0025*** | (2019.01) |
| ***F24F 13/20*** | (2006.01) |

(58) Field of Classification Search
USPC ..... 165/122
See application file for complete search history.

(56) References Cited

U.S. PATENT DOCUMENTS

| | | | | |
|---|---|---|---|---|
| 4,782,999 | A * | 11/1988 | Ishii | F24F 1/0011 236/49.3 |
| 5,194,043 | A * | 3/1993 | Takahashi | F24F 1/0007 454/316 |
| 2004/0007002 | A1 | 1/2004 | Asami et al. | |
| 2016/0363343 | A1 | 12/2016 | Okamoto et al. | |
| 2017/0261224 | A1 | 9/2017 | Okamoto et al. | |

FOREIGN PATENT DOCUMENTS

| | | | |
|---|---|---|---|
| EP | 1380797 | A1 | 1/2004 |
| EP | 1707892 | A1 | 10/2006 |
| EP | 1707893 | A1 | 10/2006 |
| EP | 3124887 | A1 | 2/2017 |
| JP | 2004-125313 | A | 4/2004 |
| JP | 2009-079846 | A | 4/2009 |
| JP | 2009-085448 | A | 4/2009 |
| JP | 2015-068566 | A | 4/2015 |
| JP | 2015-102304 | A | 6/2015 |
| WO | 2015-145726 | A1 | 10/2015 |

OTHER PUBLICATIONS

International Search Report ("ISR") dated Apr. 26, 2016 issued in corresponding International patent application No. PCT/JP21016/052879.

Extended EP Search Report ("EESR") dated Jan. 24, 2018 issued in corresponding EP patent application No. 16867432.3.

* cited by examiner

INDOOR UNIT FOR AIR-CONDITIONING APPARATUS

CROSS REFERENCE TO RELATED APPLICATION

This application is a U.S. national stage application of PCT/JP2016/052879 filed on Feb. 1, 2016, the contents of which are incorporated herein by reference.

TECHNICAL FIELD

The present invention relates to an indoor unit for an air-conditioning apparatus having an air outlet provided only in a bottom surface of a casing.

BACKGROUND ART

A known indoor unit for an air-conditioning apparatus has an inconspicuous air outlet for improved appearance (refer to Patent Literature 1, for example).

Patent Literature 1 discloses an indoor unit for an air-conditioning apparatus that includes an air-sending fan disposed in an air passage extending from an air inlet to an air outlet, a heat exchanger disposed around the air-sending fan, and a vertical deflector rotatably supported in the vicinity of the air outlet and extending in a longitudinal direction of the air outlet. The air outlet is provided only in a bottom surface of a casing of the indoor unit.

CITATION LIST

Patent Literature

Patent Literature 1: Japanese Unexamined Patent Application Publication No. 2015-68566

SUMMARY OF INVENTION

Technical Problem

As the known indoor unit for an air-conditioning apparatus has the air outlet provided only in the bottom surface of the casing, a casing front wall that defines a front surface of the air passage obstructs air blown in the forward direction during a cooling operation. Consequently, air blown in the forward direction is insufficient and cold air is applied to the head of a user, reducing comfort.

Furthermore, a part of the cold air flows along the casing front wall so that a part of a front panel close to the air outlet is directly cooled and the front panel in contact with the cooled casing front wall is cooled by heat conduction.

Consequently, air surrounding the part of the front panel close to the air outlet is cooled to the dew-point temperature or lower, causing condensation on the part of the front panel close to the air outlet. When the cooling operation is continued, drops of water on the front panel finally falls from the casing and stains on, for example, furniture, a floor, and a wall surrounding the indoor unit.

The present invention is aimed to solve the above-described problems and provides an indoor unit for an air-conditioning apparatus that can blow air in the forward direction and reduce or eliminate condensation on a front portion of a casing.

Solution to Problem

An embodiment of the present invention provides an indoor unit for an air-conditioning apparatus including a box-shaped casing having an air inlet in a top surface of the casing and an air outlet in a bottom surface of the casing, an air-sending device disposed in the casing and configured to suck in indoor air through the air inlet and blow conditioned air through the air outlet, a heat exchanger disposed in the casing and configured to cause the indoor air to exchange heat with refrigerant to supply the conditioned air, a vertical deflector, a first auxiliary vertical deflector, and a second auxiliary vertical deflector each rotatably arranged in the air outlet and configured to change an air flow direction in a vertical direction. During a cooling operation, the first auxiliary vertical deflector is positioned on a side of a front surface of the casing, a downstream end of the first auxiliary vertical deflector is positioned below the bottom surface of the casing, the second auxiliary vertical deflector is positioned below the first auxiliary vertical deflector, and an upstream end of the second auxiliary vertical deflector is positioned above the vertical deflector.

Advantageous Effects of Invention

In the indoor unit for an air-conditioning apparatus according to the embodiment of the present invention, during the cooling operation, the first auxiliary vertical deflector is positioned on the side of the front surface of the casing, the downstream end of the first auxiliary vertical deflector is positioned below the bottom surface of the casing, the second auxiliary vertical deflector is positioned below the first auxiliary vertical deflector, and the upstream end of the second auxiliary vertical deflector is positioned above the vertical deflector.

During the cooling operation, consequently, cold air flows along the first auxiliary vertical deflector without cooling a part of the casing positioned forward of the first auxiliary vertical deflector. Thus, the front surface of the casing is not cooled, thereby reducing or eliminating condensation on the front surface of the casing. Furthermore, the cold air guided downward by the first auxiliary vertical deflector and the vertical deflector is directed forward by the second auxiliary vertical deflector positioned below the first auxiliary vertical deflector, thus air can be blown in the forward direction.

DESCRIPTION OF EMBODIMENTS

Figure 1:
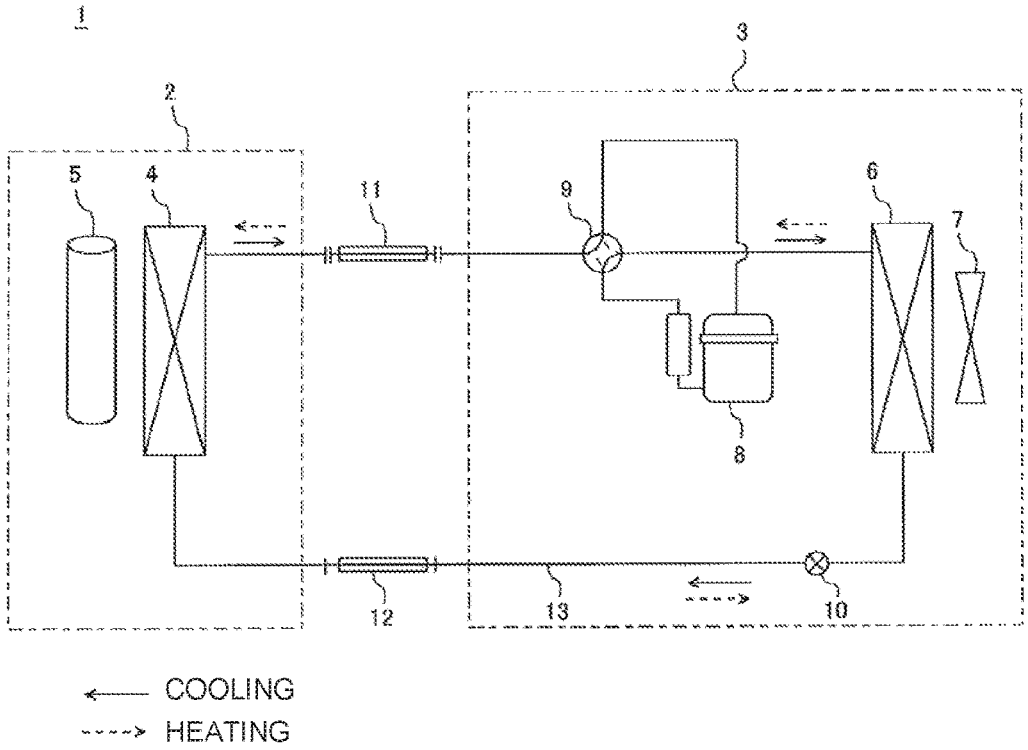
FIG. 1 is a schematic diagram illustrating a refrigerant circuit of an air-conditioning apparatus according to Embodiment of the present invention.

Embodiment of the present invention will be described below with reference to the drawings. The present invention is not limited to Embodiment described below. Note that the dimensional relationship between components in the drawings may differ from the actual dimensional relationship.

Embodiment

<Configuration of Air-Conditioning Apparatus>

FIG. 1 is a schematic diagram illustrating a refrigerant circuit 13 of an air-conditioning apparatus 1 according to Embodiment of the present invention.

As illustrated in FIG. 1, the air-conditioning apparatus 1 includes an indoor unit 2 and an outdoor unit 3. The indoor unit 2 includes an indoor heat exchanger 4 and an indoor air-sending device 5. The outdoor unit 3 includes an outdoor heat exchanger 6, an outdoor air-sending device 7, a compressor 8, a four-way switching valve 9, and an expansion valve 10. The indoor unit 2 and the outdoor unit 3 are connected to each other by a gas-side connecting pipe 11 and a liquid-side connecting pipe 12, thus forming the refrigerant circuit 13.

The indoor air-sending device 5 corresponds to an air-sending device in the present invention.

The refrigerant circuit 13 includes the compressor 8, the four-way switching valve 9, the outdoor heat exchanger 6, the expansion valve 10, and the indoor heat exchanger 4 connected sequentially by pipes and refrigerant circulates through the refrigerant circuit 13.

In the air-conditioning apparatus 1, switching between passages of the four-way switching valve 9 enables switching between a cooling operation and a heating operation. When the four-way switching valve 9 has passages indicated by solid lines in FIG. 1, the air-conditioning apparatus 1 performs the cooling operation. When the four-way switching valve 9 has passages indicated by dashed lines in FIG. 1, the air-conditioning apparatus 1 performs the heating operation.

<Configuration of Indoor Unit>

Figure 2:
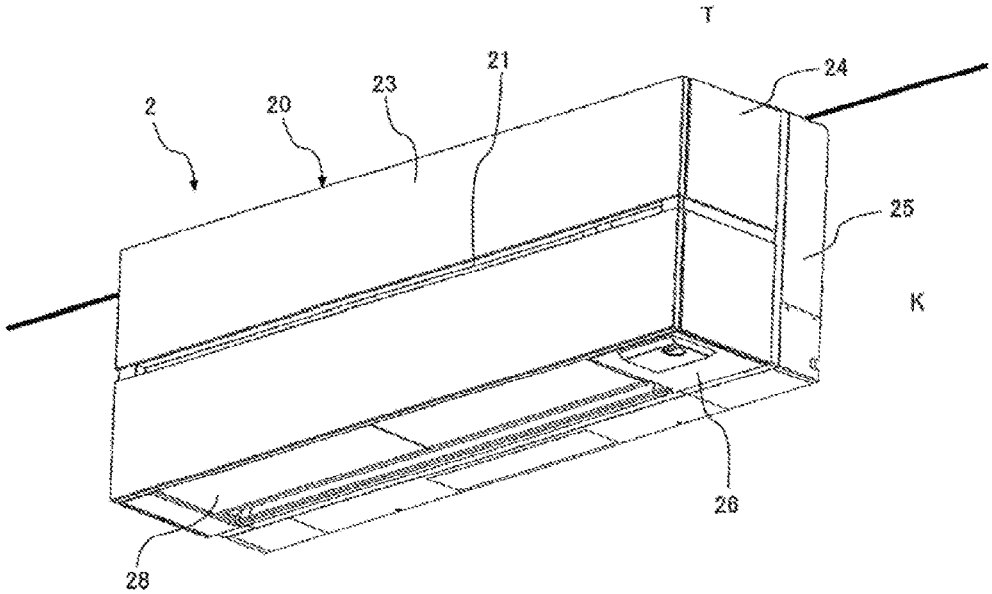
FIG. 2 is a perspective view of an indoor unit of the air-conditioning apparatus according to Embodiment of the present invention as viewed from a front side.
Figure 3:
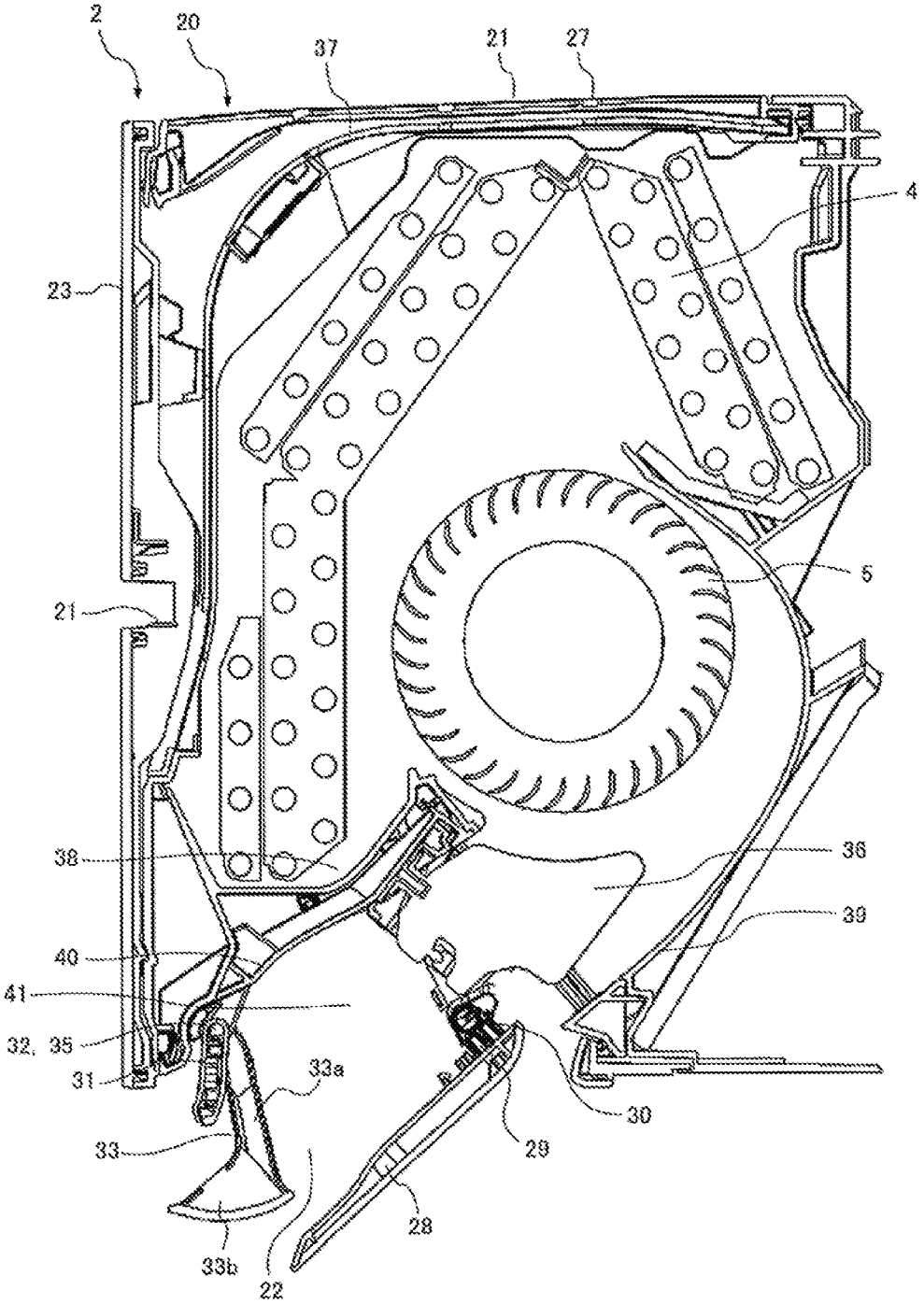
FIG. 3 is a schematic cross-sectional view of the indoor unit of the air-conditioning apparatus according to Embodiment of the present invention as viewed from a side when the indoor unit is operated.

FIG. 2 is a perspective view of the indoor unit 2 of the air-conditioning apparatus 1 according to Embodiment of the present invention as viewed from a front side. FIG. 3 is a schematic cross-sectional view of the indoor unit 2 of the air-conditioning apparatus 1 according to Embodiment of the present invention as viewed from a side when the indoor unit 2 is operated.

In the following description, the term "rear surface" refers to a surface of the indoor unit 2 on a side of a wall K in FIG. 2, the term "front surface" refers to a surface opposite to the rear surface, the term "top surface" refers to a surface of the indoor unit 2 on a side of a ceiling T, the term "bottom surface" refers to a surface opposite to the top surface, the term "right side surface" refers to a surface of the indoor unit 2 on the right of FIG. 2, and the term "left side surface" refers to a surface opposite to the right side surface. The same applies to internal components of the indoor unit 2. For air flow directions, the term "upward" refers to a direction toward the top surface, the term "downward" refers to a direction toward the bottom surface, the term "forward" refers to a direction toward the front surface, the term "rearward" refers to a direction toward the rear surface, the term "leftward" refers to a direction toward the left side surface, and the term "rightward" refers to a direction toward the right side surface.

As illustrated in FIG. 2, the indoor unit 2 includes a laterally long, rectangular parallelepiped casing 20. The shape of the casing 20 is not limited to such a laterally long, rectangular parallelepiped shape. The casing 20 may have any box-like shape that has one or more openings, such as air inlets 21 in the top and front surfaces as illustrated in FIG. 3, through which indoor air is sucked into the casing and one or more openings, such as an air outlet 22 in the bottom surface, through which conditioned air is blown out of the casing.

In the indoor unit 2 having a laterally long, rectangular parallelepiped shape as illustrated in FIG. 2, the front and bottom surfaces of the casing 20, namely, a front panel 23 and a bottom panel 26 form a corner. In the case where the air outlet 22 is provided only in the bottom surface of the casing 20 and the indoor unit 2 is stopped, the air outlet 22 is invisible when the indoor unit 2 is viewed from the front, thereby improving the quality of design.

The casing 20 has the front surface covered by the front panel 23, the right and left side surfaces covered by side panels 24, the rear surface covered by a rear panel 25, the bottom surface covered by the rear panel 25, the bottom panel 26, and a vertical deflector 28, and the top surface covered by a top panel 27. The front panel 23 has a recessed opening extending in the longitudinal direction of the casing 20, that is, extending horizontally or laterally. The top panel 27 has openings arranged in a lattice pattern. These openings serve as the air inlet 21. Although the air inlets 21 are arranged not only in the top panel 27 but also in the front panel 23 in Embodiment, the air inlet 21 is only required to be arranged in the top panel 27.

As illustrated in FIG. 3, the casing 20 includes a casing rear wall 39, serving as a rear surface of an air passage 41, disposed on a side of an inner rear surface of the casing 20 and a casing front wall 40, serving as a front surface of the air passage 41, disposed on a side of an inner front surface of the casing 20. The casing rear wall 39 and the casing front wall 40 define the air passage 41 on a downstream side of the indoor air-sending device 5. Specifically, the casing rear wall 39 and the casing front wall 40 extend from the downstream side of the indoor air-sending device 5 to the air outlet 22 and air from the indoor air-sending device 5 is guided to the air outlet 22.

In the vicinity of the air outlet 22, horizontal deflectors 36 for changing an air flow direction in a horizontal or lateral direction are arranged. Furthermore, the vertical deflector 28, a first auxiliary vertical deflector 31, and a second auxiliary vertical deflector 33 are arranged to change the air flow direction in a vertical or perpendicular direction. The casing 20 accommodates the indoor air-sending device 5, driven by a motor (not illustrated), for producing an air flow. The indoor heat exchanger 4 is disposed around the indoor air-sending device 5. The indoor heat exchanger 4 causes the refrigerant circulating through the refrigerant circuit 13 to exchange heat with the indoor air supplied by the indoor air-sending device 5 to prepare conditioned air. A filter 37 is disposed upstream of the indoor heat exchanger 4. A drain pan 38 for receiving drain water from the indoor heat exchanger 4 is disposed under the indoor heat exchanger 4.

An air flow in the indoor unit 2 will be briefly described below.

The filter 37 removes dust from the indoor air sucked in through the air inlets 21. While the indoor air is passing through the indoor heat exchanger 4, the indoor air exchanges heat with the refrigerant flowing in the indoor heat exchanger 4 to be cooled in the cooling operation or heated in the heating operation, and then reaches the indoor air-sending device 5. The conditioned air passes through the indoor air-sending device 5 or a clearance between the indoor air-sending device 5 and the rear panel 25 and then passes through the air passage 41. Subsequently, the air is blown forward or downward from the air outlet 22.

<Vertical Deflector 28>

As illustrated in FIGS. 2 and 3, the vertical deflector 28 constitutes a part of the bottom surface of the casing 20. The vertical deflector 28 is disposed close to a lower part of the casing rear wall 39 disposed on the side of the inner rear surface of the casing 20 and is supported rotatably about a vertical deflector rotation shaft 30 by a vertical deflector support member 29. The vertical deflector 28 extends in the longitudinal direction of the casing 20, changes the direction of air blown from the air outlet 22 in the vertical direction, and opens or closes the air outlet 22.

The vertical deflector 28 is driven by a driving motor (not illustrated) and is rotatable about the vertical deflector rotation shaft 30 in a range from an upper structural limit (fully closed position) to a lower structural limit (fully opened position).

<First Auxiliary Vertical Deflector 31>

As illustrated in FIG. 3, the first auxiliary vertical deflector 31 is disposed close to a lower part of the casing front wall 40 disposed on the side of the inner front surface of the casing 20. The first auxiliary vertical deflector 31 is rotatably supported at one end and is rotatable 90 degrees or more about a first auxiliary vertical deflector shaft 32. The first auxiliary vertical deflector 31 extends in the longitudinal direction of the casing 20, changes the direction of air blown from the air outlet 22 in the vertical direction, and reduces or eliminates condensation on the front panel 23.

During the cooling operation, the first auxiliary vertical deflector 31 is positioned to extend from the lower part of the casing front wall 40 downward of the bottom surface of the casing 20. Specifically, the first auxiliary vertical deflector 31 has an end (hereinafter, referred to as an "upstream end") that is located on an upstream side of the air flow and serves as a supporting point and another end (hereinafter, referred to as a "downstream end") that is located on a downstream side of the air flow and does not serve as a supporting point. The upstream end of the first auxiliary vertical deflector 31 is positioned on the lower part of the casing front wall 40 and the downstream end of the first auxiliary vertical deflector 31 protrudes from the air outlet 22 and is positioned below the bottom surface of the casing 20.

Figure 4:
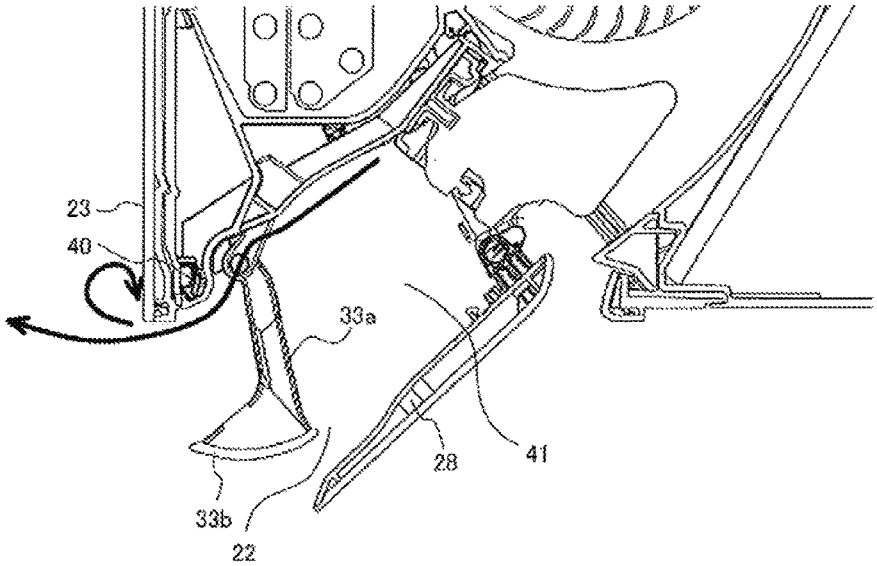
FIG. 4 is a schematic cross-sectional view of an air outlet and its surrounding part of the indoor unit of the air-conditioning apparatus according to Embodiment of the present invention as viewed from the side and illustrates a case where the indoor unit includes no first auxiliary vertical deflector.

FIG. 4 is a schematic cross-sectional view of the air outlet 22 and its surrounding part of the indoor unit 2 of the air-conditioning apparatus 1 according to Embodiment of the present invention as viewed from the side and illustrates a case where the indoor unit 2 includes no first auxiliary vertical deflector 31.

In the case where the first auxiliary vertical deflector 31 is not provided, during the cooling operation, cold air blown along the casing front wall 40 flows as indicated by arrows in FIG. 4. The cold air contacts the lower part of the front panel 23 close to the air outlet 22, thus cooling the front panel 23.

Even when the cold air does not directly contact the front panel 23, the lower part of the casing front wall 40 close to the air outlet 22 is cooled by the cold air, and hence the front panel 23 in contact with the casing front wall 40 is cooled by heat conduction. The air surrounding the lower part of the front panel 23, directly cooled by the cold air or cooled by heat conduction, close to the air outlet 22 is cooled to the dew-point temperature or lower, causing condensation on the front panel 23 in the vicinity of the air outlet 22. When the cooling operation is continued, drops of water on the front panel 23 finally falls from the casing 20 and stains on, for example, furniture, a floor, and the wall surrounding the indoor unit 2.

Figure 5:
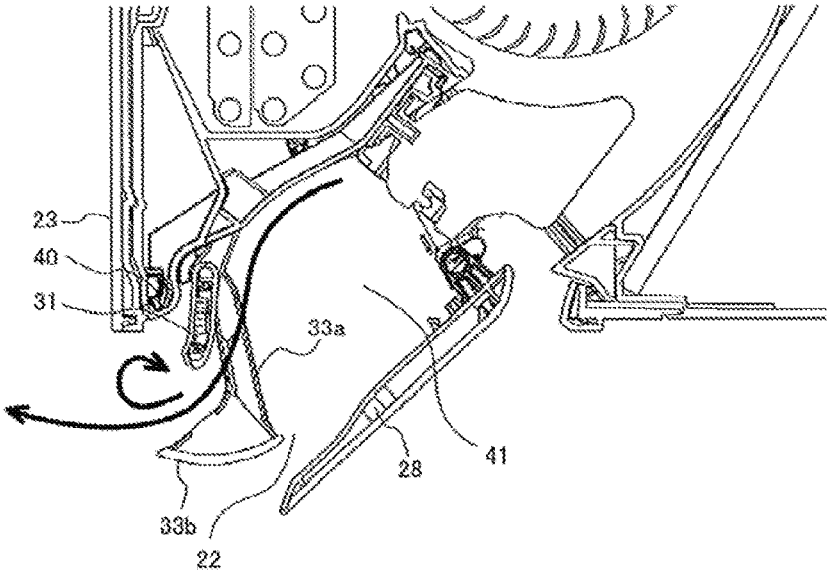
FIG. 5 is a schematic cross-sectional view of the air outlet and its surrounding part of the indoor unit of the air-conditioning apparatus according to Embodiment of the present invention as viewed from the side.

FIG. 5 is a schematic cross-sectional view of the air outlet 22 and its surrounding part of the indoor unit 2 of the air-conditioning apparatus 1 according to Embodiment of the present invention as viewed from the side.

In the case where the first auxiliary vertical deflector 31 is provided, the first auxiliary vertical deflector 31 prevents cold air blown along the casing front wall 40 during the cooling operation from contacting the lower part of the front panel 23 close to the air outlet 22, as indicated by arrows in FIG. 5. The cold air flows downward along the first auxiliary vertical deflector 31 and the cold air does not directly contact the front panel 23. Although the cold air blown from the air outlet 22 cools an upstream surface part of the first auxiliary vertical deflector 31, condensation does not occur on a downstream surface part of the first auxiliary vertical deflector 31 in contact with moist indoor air because the first auxiliary vertical deflector 31 has a hollow structure and thus offers heat insulation.

Furthermore, the first auxiliary vertical deflector 31 prevents the lower part of the casing front wall 40 close to the air outlet 22 from directly contacting cold air. In other words, a part of the casing front wall 40 disposed forward of the first auxiliary vertical deflector 31 is not cooled and the front panel 23 in contact with the casing front wall 40 is not cooled by heat conduction.

As described above, the first auxiliary vertical deflector 31, disposed as illustrated in FIG. 5, prevents the front panel 23 from being cooled due to cold air. Consequently, the front panel 23 has substantially the same temperature as that of its surrounding air, thereby reducing or eliminating condensation on the front panel 23.

The mechanism of the first auxiliary vertical deflector 31 is not limited to such a mechanism in which the first auxiliary vertical deflector 31 rotates about the first auxiliary vertical deflector shaft 32. The first auxiliary vertical deflector 31 may have a mechanism in which the first auxiliary vertical deflector 31 slides up and down. Furthermore, a water-absorbing material having a rear surface coated with an adhesive or glue may be attached to a free end of the first auxiliary vertical deflector 31. Consequently, the water-absorbing material can absorb and prevent drops of water on the first auxiliary vertical deflector 31 from falling from the casing 20.

<Second Auxiliary Vertical Deflector 33>

As illustrated in FIG. 3, the second auxiliary vertical deflector 33 includes supports 33*a* each supported at an end and rotatable about a second auxiliary vertical deflector shaft 35 and a guide 33*b* disposed at other ends of the supports 33*a*.

Each support 33*a* is long in one direction, that is, has a vertically long shape in side view. The guide 33*b* protrudes perpendicularly to the supports 33*a* and has a curved surface having an arc shape in side view. The supports 33*a* are arranged at several positions, for example, two positions in the longitudinal direction of the casing 20 and spaced apart from each other. Thus, a clearance is left between the closest ones of the supports 33*a*. The guide 33*b* extends in the longitudinal direction of the casing 20 and changes the direction of air blown from the air outlet 22 in the vertical direction. For example, when the guide 33*b* is inclined horizontally, an air flow passing through the clearance between the supports 33*a* can be guided horizontally, thus air can be blown in the forward direction.

Furthermore, the second auxiliary vertical deflector 33 can rotate 90 degrees or more about the second auxiliary vertical deflector shaft 35.

Although the surface of the guide 33*b* is not limited to have the arc-shaped curved surface in side view, the arc-shaped curved surface more easily guides an air flow than a flat surface. In addition, the guide 33*b* does not necessarily have to project exactly perpendicularly to the supports 33*a* in side view.

During the cooling operation, as illustrated in FIG. 3, the guide 33*b* is positioned at a distance from and below the first auxiliary vertical deflector 31. In addition, a downstream end of the guide 33*b* is positioned forward of the first auxiliary vertical deflector 31, namely, closer to the front surface of the casing 20 than the first auxiliary vertical deflector 31 is positioned, and an upstream end of the guide 33*b* is positioned above a downstream end of the vertical deflector 28.

Figure 6:
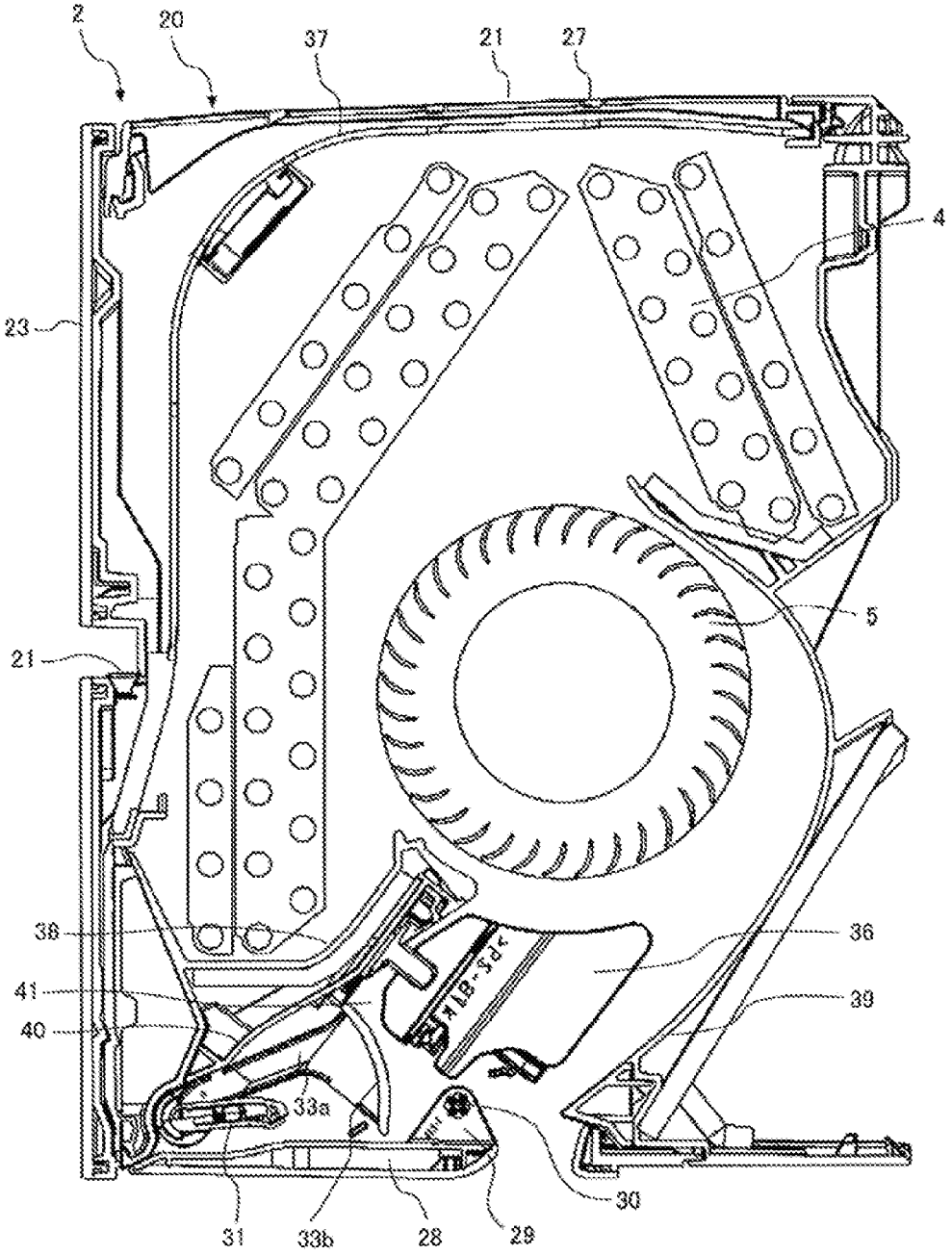
FIG. 6 is a schematic cross-sectional view of the indoor unit of the air-conditioning apparatus according to Embodiment of the present invention as viewed from the side when the indoor unit is stopped.

FIG. 6 is a schematic cross-sectional view of the indoor unit 2 of the air-conditioning apparatus 1 according to Embodiment of the present invention as viewed from the side when the indoor unit 2 is stopped.

The second auxiliary vertical deflector 33 is positioned in the air passage 41 when the indoor unit 2 is stopped as illustrated in FIG. 6.

Figure 7:
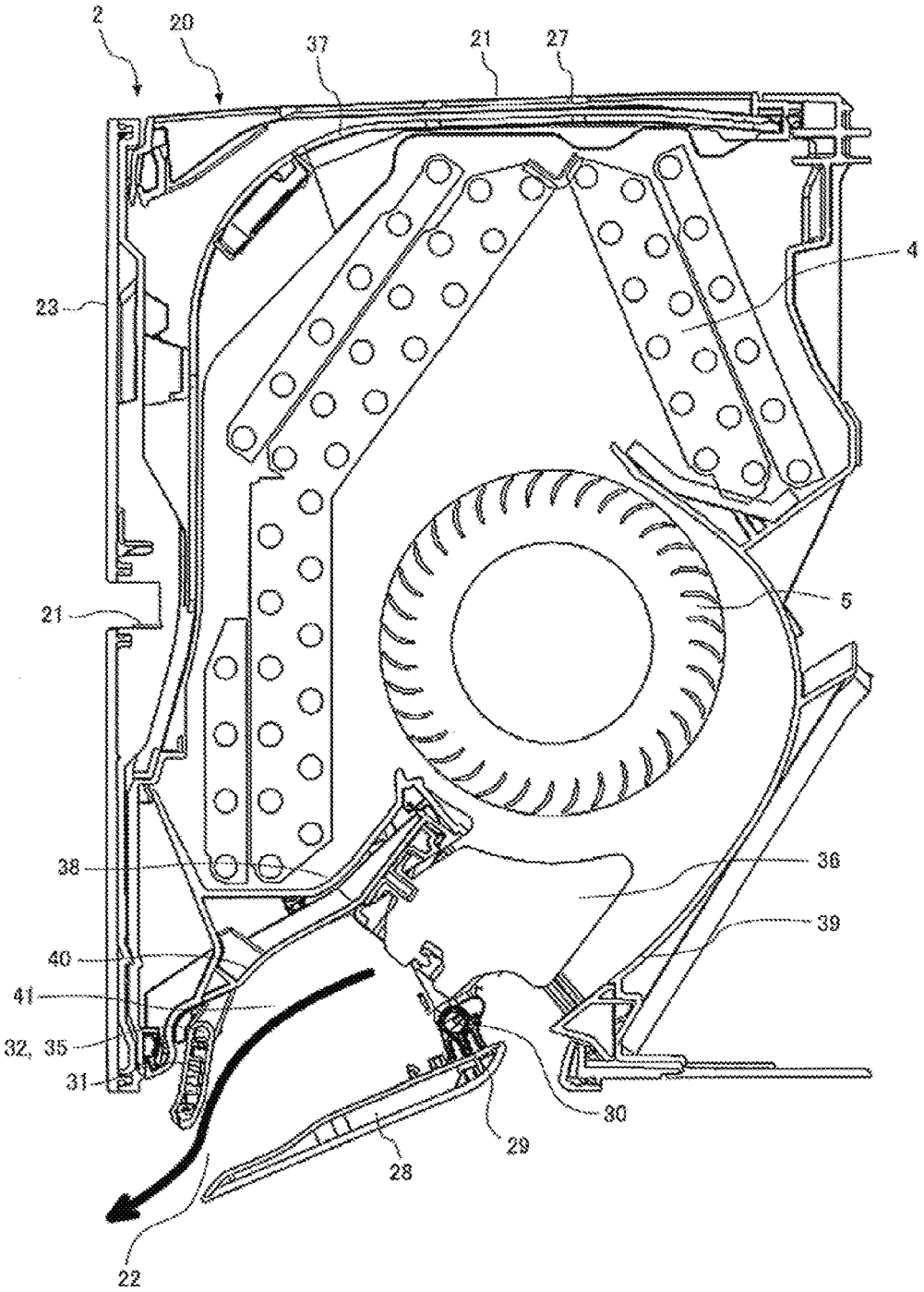
FIG. 7 is a schematic cross-sectional view of the indoor unit of the air-conditioning apparatus according to Embodiment of the present invention as viewed from the side when the indoor unit is operated and illustrates a case where the indoor unit includes no second auxiliary vertical deflector.

FIG. 7 is a schematic cross-sectional view of the indoor unit 2 of the air-conditioning apparatus 1 according to Embodiment of the present invention as viewed from the side when the indoor unit 2 is operated and illustrates a case where the indoor unit 2 includes no second auxiliary vertical deflector 33.

In the case where the second auxiliary vertical deflector 33 is not provided as illustrated in FIG. 7, when the air flow direction is to be changed to the forward direction by using the vertical deflector 28 in the cooling operation, the vertical deflector 28 has to be inclined horizontally. However, the air outlet 22 is caused to become narrower as illustrated in FIG. 7, leading to increased pressure loss and hence a reduced amount of air.

Furthermore, as the vertical deflector 28 is further inclined horizontally, cold air flowing along a rear surface (design surface, that is, bottom surface when the indoor unit 2 is stopped) of the vertical deflector 28 is insufficient. Cooling of a front surface (air-passage facing surface, that is, top surface when the indoor unit 2 is stopped) of the vertical deflector 28 causes the rear surface to reach the dew-point temperature or lower, leading to condensation. In addition, the casing front wall 40 and the first auxiliary vertical deflector 31 obstruct air blown in the forward direction.

Consequently, air blown in the forward direction is insufficient and cold air is applied to the head of a user, reducing comfort.

In contrast, in the case where the second auxiliary vertical deflector 33 is provided as illustrated in FIG. 3, during the cooling operation, the guide 33*b* is positioned at a distance from and below the first auxiliary vertical deflector 31 and the downstream end of the guide 33*b* is positioned forward of the first auxiliary vertical deflector 31, namely, closer to the front surface of the casing 20 than the first auxiliary vertical deflector 31 is positioned. Consequently, cold air flowing downward along the casing front wall 40 and the first auxiliary vertical deflector 31 can be directed forward by the guide 33*b* of the second auxiliary vertical deflector 33 without being obstructed by the casing front wall 40 and the first auxiliary vertical deflector 31. Consequently, the cold air flowing between the first auxiliary vertical deflector 31 and the second auxiliary vertical deflector 33 is reduced, thus the cold air is not applied to the head of a user and hence the comfort of the user is improved.

Furthermore, an upstream end of the vertical deflector 28 is positioned forward of a downstream end of the casing rear wall 39, namely, closer to the front surface of the casing 20 than the downstream end of the casing rear wall 39 is positioned. The upstream end of the vertical deflector 28 is spaced apart from the downstream end of the casing rear wall 39. The upstream end of the vertical deflector 28 is positioned above the downstream end of the casing rear wall 39 or a downstream extension of the casing rear wall 39, thus facilitating the supply of cold air along the rear side of the vertical deflector 28. Consequently, the vertical deflector 28 can be inclined horizontally, thus enabling the direction in which the cold air flows along the rear side of the vertical deflector 28 to more closely follow the forward direction.

As the cold air guided by the vertical deflector 28 flows along a rear side of the second auxiliary vertical deflector 33, condensation does not occur on the second auxiliary vertical deflector 33.

Figure 8:
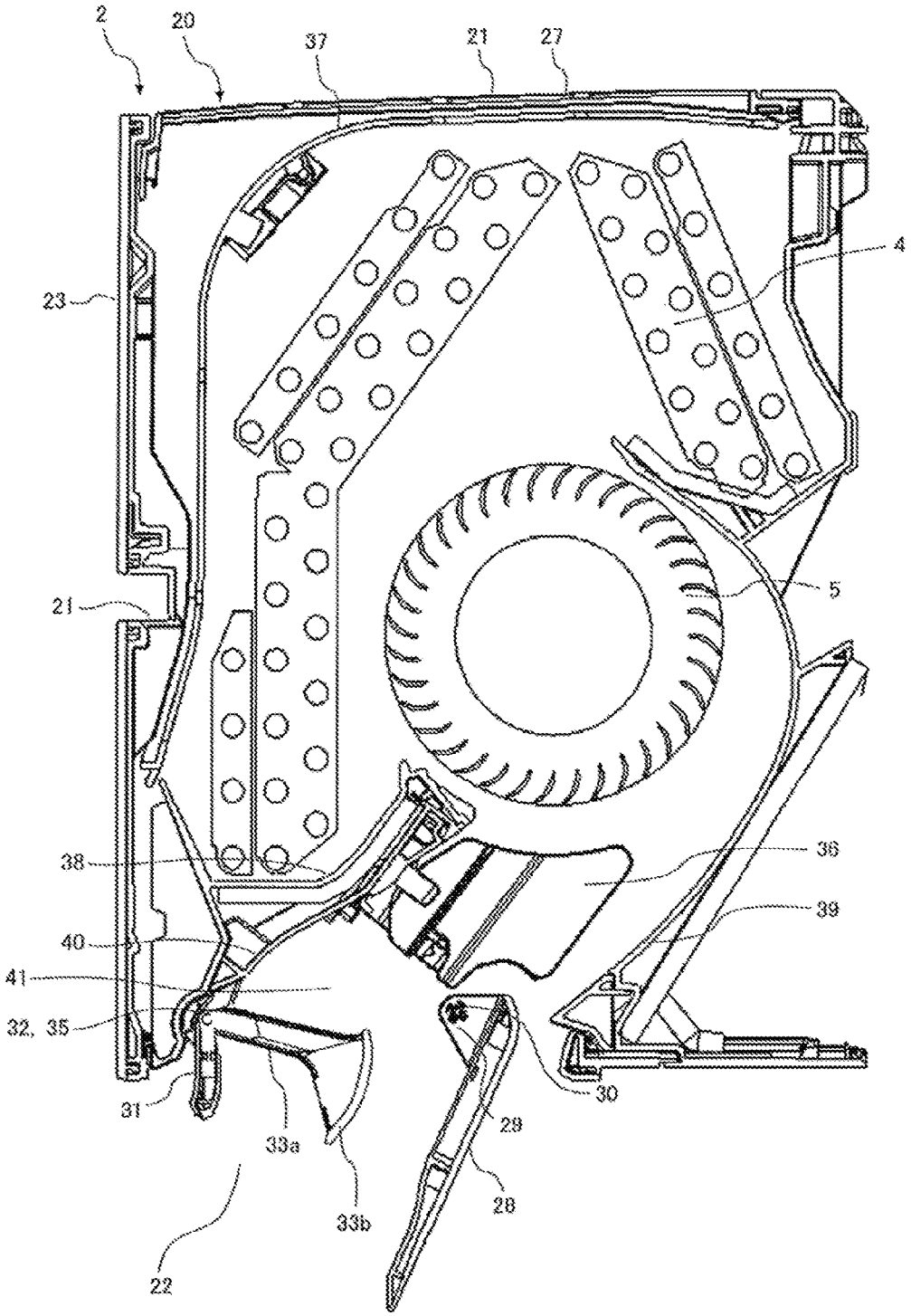
FIG. 8 is a schematic cross-sectional view of the indoor unit of the air-conditioning apparatus according to Embodiment of the present invention as viewed from the side when the indoor unit is operated to blow air downward.

FIG. 8 is a schematic cross-sectional view of the indoor unit 2 of the air-conditioning apparatus 1 according to Embodiment of the present invention as viewed from the side when the indoor unit 2 is operated to blow air downward.

When the indoor unit 2 is operated to blow air downward, as illustrated in FIG. 8, the vertical deflector 28 is downwardly inclined at 65 to 90 degrees from the horizontal direction, the first auxiliary vertical deflector 31 is downwardly inclined at 85 to 90 degrees from the horizontal direction, the second auxiliary vertical deflector 33 is downwardly inclined at 65 to 90 degrees from the horizontal direction and hence air can be blown substantially straight downward. Consequently, a wider air blowing range than that of known air-conditioning apparatuses is achieved.

In the case where the first auxiliary vertical deflector 31 is rotatably supported about the first auxiliary vertical deflector shaft 32, as illustrated in FIG. 6, the end that does not serve as a supporting point of the first auxiliary vertical deflector 31 is positioned above the vertical deflector 28 when the indoor unit 2 is stopped. In the case where the second auxiliary vertical deflector 33 is rotatably supported about the second auxiliary vertical deflector shaft 35, the guide 33*b* is positioned rearward of the first auxiliary vertical deflector 31 and is positioned above the vertical deflector 28 when the indoor unit 2 is stopped. A configuration in which the vertical deflector 28, the first auxiliary vertical deflector 31, and the second auxiliary vertical deflector 33 do not interfere with one another and the air outlet 22 is closed by the vertical deflector 28 makes the air passage 41 invisible, thus enhancing the design quality when the indoor unit 2 is stopped.

In the indoor unit 2 of the air-conditioning apparatus 1 according to Embodiment, during the cooling operation, the first auxiliary vertical deflector 31 is positioned on the front side of the air outlet 22, namely, on the side of the front surface of the casing 20 and the downstream end of the first auxiliary vertical deflector 31 is positioned below the bottom surface of the casing 20. The second auxiliary vertical deflector 33 is positioned below the first auxiliary vertical deflector 31 and the upstream end of the second auxiliary vertical deflector 33 is positioned above the vertical deflector 28. The first auxiliary vertical deflector 31 is positioned to extend from the lower part of the casing front wall 40 downward of the bottom surface of the casing 20. The guide 33*b* of the second auxiliary vertical deflector 33 is positioned below the first auxiliary vertical deflector 31 and the upstream end of the guide 33*b* is positioned above the vertical deflector 28.

Consequently, cold air guided downward by the first auxiliary vertical deflector 31 and the vertical deflector 28 is directed forward by the guide 33*b* of the second auxiliary vertical deflector 33 positioned below the first auxiliary vertical deflector 31, thus air can be blown in the forward direction. As the second auxiliary vertical deflector 33 is used to forwardly direct an air flow, the angle of the vertical deflector 28 can be increased. Thus, the air outlet 22 can be widened, leading to low pressure loss and hence performance improvement. As the cold air guided by the vertical deflector 28 flows along the rear side of the second auxiliary vertical deflector 33, condensation does not occur on the second auxiliary vertical deflector 33. Furthermore, the cold air flows along the first auxiliary vertical deflector 31 without cooling a part of the casing front wall 40 disposed forward of the first auxiliary vertical deflector 31. Consequently, the front surface of the casing 20 is not cooled. Thus, condensation does not occur on the front surface of the casing 20.

During the cooling operation, the downstream end of the vertical deflector 28 is positioned above the bottom surface of the casing 20. Consequently, the supply of cold air along the rear side of the vertical deflector 28 is facilitated, thus allowing the vertical deflector 28 to have a wider range of angles at which condensation does not occur. Thus, the air outlet 22 can be widened, leading to low pressure loss and hence performance improvement.

During the cooling operation, the downstream end of the guide 33*b* of the second auxiliary vertical deflector 33 is positioned forward of the first auxiliary vertical deflector 31, namely, closer to the front surface of the casing 20 than the first auxiliary vertical deflector 31 is positioned. Consequently, cold air flowing downward along the casing front wall 40 and the first auxiliary vertical deflector 31 can be directed forward by the second auxiliary vertical deflector 33. Consequently, the cold air flowing between the first auxiliary vertical deflector 31 and the second auxiliary vertical deflector 33 is reduced, thus the cold air is not applied to the head of a user and hence the comfort of the user is improved.

During the cooling operation, the upstream end of the vertical deflector 28 is positioned forward of the downstream end of the casing rear wall 39, namely, closer to the front surface of the casing 20 than the downstream end of the casing rear wall 39 is positioned. The upstream end of the vertical deflector 28 is spaced apart from the downstream end of the casing rear wall 39. Consequently, the supply of cold air along the rear side of the vertical deflector 28 is facilitated. When the vertical deflector 28 is further inclined horizontally, condensation does not occur on the rear surface of the vertical deflector 28. Inclining the vertical deflector 28 horizontally enables the direction in which the cold air flows along the rear side of the vertical deflector 28 to more closely follow the forward direction.

During the cooling operation, the upstream end of the vertical deflector 28 is positioned above the downstream end of the casing rear wall 39 or the downstream extension of the casing rear wall 39. Consequently, the supply of cold air along the rear side of the vertical deflector 28 is facilitated. Consequently, when the vertical deflector 28 is further inclined horizontally, condensation does not occur on the rear surface of the vertical deflector 28. Inclining the vertical deflector 28 horizontally enables the direction in which the cold air flows along the rear side of the vertical deflector 28 to more closely follow the forward direction.

When the indoor unit 2 is stopped, the first auxiliary vertical deflector 31 and the second auxiliary vertical deflector 33 are accommodated in the casing 20.

Advantageously, degradation in design quality when the indoor unit 2 is stopped is eliminated.

The front and bottom surfaces of the casing 20, that is, the front panel 23 and the bottom panel 26 form the corner. In the case where the air outlet 22 is provided only in the bottom surface of the casing 20, the air outlet 22 is invisible when the indoor unit 2 is viewed from the front and the indoor unit 2 is stopped, thus enhancing the design quality.

REFERENCE SIGNS LIST air-conditioning apparatus 2 indoor unit 3 outdoor unit 4 indoor heat exchanger 5 indoor air-sending device 6 outdoor heat exchanger 7 outdoor air-sending device 8 compressor 9 four-way switching valve 10 expansion valve 11 gas-side connecting pipe 12 liquid-side connecting pipe 13 refrigerant circuit 20 casing 21 air inlet 22 air outlet 23 front panel side panel 25 rear panel 26 bottom panel 27 top panel 28 vertical deflector 29 vertical deflector support member 30 vertical deflector rotation shaft 31 first auxiliary vertical deflector 32 first auxiliary vertical deflector shaft second auxiliary vertical deflector 33*a* support 33*b* guide 35 second auxiliary vertical deflector shaft 36 horizontal deflector 37 filter 38 drain pan casing rear wall 40 casing front wall 41 air passage

The invention claimed is:

1. An indoor unit for an air-conditioning apparatus, the indoor unit comprising:

a box-shaped casing having an air inlet in a top surface of the casing and an air outlet in a bottom surface of the casing;

an air-sending device disposed in the casing, the air-sending device being configured to suck in indoor air through the air inlet and blow conditioned air through the air outlet;

a heat exchanger disposed in the casing, the heat exchanger being configured to cause the indoor air to exchange heat with refrigerant to supply the conditioned air;

a vertical deflector; a first auxiliary vertical deflector; and a second auxiliary vertical deflector each rotatably arranged in the air outlet and configured to change an air flow direction in a vertical direction, the second auxiliary vertical deflector including a support and a guide, the support being rotatably supported at an end, the guide being disposed at an other end of the support and protruding perpendicular to the support in side view, during a cooling operation, the first auxiliary vertical deflector being positioned on a side of a front surface of the casing, a downstream end of the first auxiliary vertical deflector being positioned below the bottom surface of the casing, the second auxiliary vertical deflector being positioned below the first auxiliary vertical deflector, an upstream end of the second auxiliary vertical deflector being positioned above the vertical deflector, during the cooling operation, the guide of the second auxiliary vertical deflector being positioned below the first auxiliary vertical deflector, an upstream end of the guide being positioned above the vertical deflector.

2. The indoor unit for an air-conditioning apparatus of claim 1, the indoor unit further comprising:

a casing rear wall disposed on a side of an inner rear surface of the casing, the casing rear wall extending from a downstream side of the air-sending device to the air outlet; and a casing front wall disposed on a side of an inner front surface of the casing, the casing front wall extending from the downstream side of the air-sending device to the air outlet, wherein the vertical deflector, the first auxiliary vertical deflector, and the second auxiliary vertical deflector are arranged between the casing rear wall and the casing front wall, and wherein, during the cooling operation, the first auxiliary vertical deflector is positioned to extend from a lower part of the casing front wall downward of the bottom surface of the casing.

3. The indoor unit for an air-conditioning apparatus of claim 1, wherein, during the cooling operation, a downstream end of the guide of the second auxiliary vertical deflector is positioned closer to the front surface of the casing than the first auxiliary vertical deflector is positioned.

4. The indoor unit for an air-conditioning apparatus of claim 1, wherein, when the indoor unit is stopped, the first auxiliary vertical deflector and the second auxiliary vertical deflector are accommodated in the casing.

5. The indoor unit for an air-conditioning apparatus of claim 1, wherein the front surface and the bottom surface of the casing form a corner.

6. The indoor unit for an air-conditioning apparatus of claim 1, wherein, when the indoor unit is stopped, the downstream end of the first auxiliary vertical deflector is positioned above the vertical deflector, and the guide of the second auxiliary vertical deflector is positioned rearward of the first auxiliary vertical deflector and is positioned above the vertical deflector.

* * * * *